US006929039B2

(12) United States Patent
Vaitses

(10) Patent No.: US 6,929,039 B2
(45) Date of Patent: Aug. 16, 2005

(54) MARINE VESSEL FUEL OVERFLOW TANK SYSTEM

(76) Inventor: Stephen P. Vaitses, 119 Grove St., Clinton, CT (US) 06413

( * ) Notice: Subject to any disclaimer, the term of this patent is extended or adjusted under 35 U.S.C. 154(b) by 27 days.

(21) Appl. No.: 10/460,243

(22) Filed: Jun. 11, 2003

(65) Prior Publication Data

US 2004/0261899 A1 Dec. 30, 2004

(51) Int. Cl.[7] ..... B65B 1/04
(52) U.S. Cl. ..... 141/311 A; 141/86; 114/343
(58) Field of Search ..... 141/311 A, 86–88, 141/98; 220/86.2; 114/343

(56) References Cited

U.S. PATENT DOCUMENTS

| | | | | |
|---|---|---|---|---|
| 5,019,141 | A | 5/1991 | Granville et al. | 55/170 |
| 5,035,729 | A | 7/1991 | Hodgkins | 55/168 |
| 5,229,766 | A | 7/1993 | Hargest | 340/984 |
| 5,322,099 | A | 6/1994 | Langlois | 141/307 |
| 5,501,255 | A | 3/1996 | Tortu et al. | 141/95 |
| 5,515,891 | A | 5/1996 | Langlois | 141/307 |
| 5,570,730 | A | 11/1996 | Keehn, Jr. et al. | 141/59 |
| 5,727,603 | A | 3/1998 | Langlois | 141/1 |
| 5,762,093 | A | 6/1998 | Whitley, II | 137/199 |
| 5,797,434 | A | 8/1998 | Benjey et al. | 141/59 |
| 5,829,491 | A | 11/1998 | Bennett | 141/59 |
| 5,894,809 | A | 4/1999 | Grigaitis et al. | 114/343 |
| 5,950,688 | A | 9/1999 | Langlois | 141/1 |
| 5,975,154 | A | 11/1999 | Bennett | 141/59 |
| 6,152,196 | A | 11/2000 | Kehoe | 141/198 |
| 6,237,645 | B1 | 5/2001 | Pountney | 141/7 |

*Primary Examiner*—Steven O. Douglas
(74) *Attorney, Agent, or Firm*—Cantor Coburn LLP

(57) ABSTRACT

A marine vessel overflow tank system for use in the hull of a marine vessel that has a fuel system including a fuel vent line connecting a fuel tank to a vent that communicates with the atmosphere. The system comprises a first vent line fitting adapted for direct parallel communication with the fuel vent line. The internal cross sectional area of the first vent line fitting is approximately the same size as the internal cross sectional area of the fuel vent line. The system also comprises a second vent line fitting adapted for direct parallel communication with the fuel vent line. The internal cross sectional area of the second vent line fitting is approximately the same size as the internal cross sectional area of the fuel vent line. The system further comprises a fuel expansion tank. The fuel expansion tank comprises a plurality of walls defining an enclosed chamber and a first restrictive orifice located in one the walls. The first orifice is in direct communication with the first vent line fitting and has an internal cross sectional area less than the internal cross sectional area of the fuel vent line. The fuel expansion tank also comprises a second restrictive orifice located in one the walls defining the enclosed chamber. The second restrictive orifice is in direct communication with the second vent line fitting and has an internal cross sectional area less than the internal cross sectional area of the fuel vent line. The fuel expansion tank further comprises means for attaching the chamber to the hull with the first restrictive orifice being positioned above the second restrictive orifice and proximate to a top edge of the chamber, and the second restrictive orifice being positioned above the fuel tank and proximate to a bottom edge of the chamber.

22 Claims, 3 Drawing Sheets

MARINE VESSEL FUEL OVERFLOW TANK SYSTEM

BACKGROUND OF THE INVENTION

This invention relates generally to a fuel overflow tank system for a marine vessel and, more particularly, this invention relates to a fuel expansion tank utilized to store excess fuel created due to thermal expansion.

Vehicles powered by internal combustion engines have at least one fuel tank that generally holds a supply of liquid fuel for the engine. The tanks are typically connected to a filler tube that is used to introduce fuel into the tank. The outer opening of the filler tube is usually covered with a removable cap.

When fuel is added to the tank, it displaces the air in the tank. The air, which is laden with fuel vapor, rushes out of the tank as the fuel enters. In many situations, foam is created by agitation of the fuel entering the tank. In some vehicles, the displaced air and foam rushes back to the filler tube as the tank is filled and splashes out on the person filling the tank. Other fuel systems include a vent line that extends from the interior of the tank to the atmosphere. The vent line enables air to escape from the tank as it is filled with fuel through the filler tube. The vent line also enables air to enter the tank as fuel is withdrawn for delivery to the engine.

The fuel tank vent line also serves to prevent pressure from building in the tank. If the tank were un-vented, increasing temperature of the fuel would cause fuel and vapor expansion that would cause the pressure in the tank to rise. If the pressure became too high, the fuel tank could rupture, causing fire or explosion.

Fuel systems used on marine crafts usually include a vent line from the fuel tank. The vent line typically opens to the atmosphere over the water. As the fuel tank is filled to near the top, the air flowing out of the vent line can carry fuel and foam overboard on to the water. Wave action that rocks a boat can also cause fuel to be discharged overboard both during fueling and when the tank is full. In addition, thermal expansion of the fuel due to an increase in fuel temperature may also cause fuel to be discharged overboard when the tank is full.

Thermal expansion refers to the expansion of fuel when it is heated to a higher temperature. Both gasoline and diesel fuel expand when their temperature rises. For example, fifty gallons of gasoline will expand by approximately 1.61 gallons when the temperature of the gasoline increases by thirty-four degrees Celsius. Similarly, two hundred gallons of gasoline will expand by approximately 6.46 gallons when the temperature of the gasoline is raised by thirty-four degrees Celsius. Diesel fuel expands at a lower rate than gasoline. For example, fifty gallons of diesel fuel will expand by approximately 1.36 gallons and two hundred gallons of diesel fuel will expand by approximately 5.44 gallons when the temperature of the diesel fuel is raised by thirty-four degrees Celsius. Thermal expansion can cause fuel to be discharged overboard via the vent line when the fuel tank does not have the space to accommodate the excess fuel capacity. Fuel discharged overboard poses a pollution hazard and is harmful to wildlife. There is also a risk that fuel floating on the water may catch fire causing injury to life or property.

BRIEF SUMMARY OF THE INVENTION

One aspect of the invention is a marine vessel overflow tank system for use in the hull of a marine vessel that has a fuel system including a fuel vent line connecting a fuel tank to a vent that communicates with the atmosphere. The system comprises a first vent line fitting adapted for direct parallel communication with the fuel vent line. The internal cross sectional area of the first vent line fitting is approximately the same size as the internal cross sectional area of the fuel vent line. The system also comprises a second vent line fitting adapted for direct parallel communication with the fuel vent line. The internal cross sectional area of the second vent line fitting is approximately the same size as the internal cross sectional area of the fuel vent line. The system further comprises a fuel expansion tank. The fuel expansion tank comprises a plurality of walls defining an enclosed chamber and a first restrictive orifice located in one the walls. The first orifice is in direct communication with the first vent line fitting and has an internal cross sectional area less than the internal cross sectional area of the fuel vent line. The fuel expansion tank also comprises a second restrictive orifice located in one the walls defining the enclosed chamber. The second restrictive orifice is in direct communication with the second vent line fitting and has an internal cross sectional area less than the internal cross sectional area of the fuel vent line. The fuel expansion tank further comprises means for attaching the chamber to the hull with the first restrictive orifice being positioned above the second restrictive orifice and proximate to a top edge of the chamber, and the second restrictive orifice being positioned above the fuel tank and proximate to a bottom edge of the chamber.

Another aspect of the invention is the combination of a fuel system and a fuel expansion tank for use in the hull of a marine vessel. The fuel system comprises a fuel tank, a filler tube and a fuel vent line. The filler tube is open to the fuel tank for delivering fuel to the fuel tank. The fuel vent line is in fluid communication with the fuel tank and the atmosphere. The fuel vent line includes a first vent line fitting and a second vent line fitting both adapted for direct parallel communication with the fuel expansion tank. The fuel expansion tank comprises a plurality of walls defining an enclosed chamber and a first restrictive orifice located in one the walls. The first orifice is in direct communication with the first vent line fitting and has an internal cross sectional area less than the internal cross sectional area of the fuel vent line. The fuel expansion tank also comprises a second restrictive orifice located in one the walls defining the enclosed chamber. The second restrictive orifice is in direct communication with the second vent line fitting and has an internal cross sectional area less than the internal cross sectional area of the fuel vent line. The fuel expansion tank further comprises means for attaching the chamber to the hull with the first restrictive orifice being positioned above the second restrictive orifice and proximate to a top edge of the chamber, and the second restrictive orifice being positioned above the fuel tank and proximate to a bottom edge of the chamber.

A further aspect of the invention is a method of utilizing a fuel expansion tank in the hull of a marine vessel that has a fuel system. The fuel system includes a fuel vent line connecting a fuel tank to a vent that communicates with the atmosphere. In addition, the fuel vent line includes a first vent line fitting and a second vent line fitting both adapted for direct parallel communication with the fuel expansion tank. The method comprises attaching the fuel expansion tank to the marine vessel. The fuel expansion tank includes a plurality of walls defining an enclosed chamber and a first restrictive orifice located in one the walls. The first orifice is adapted for direct parallel communication with the fuel vent line and has an internal cross sectional area less than the internal cross sectional area of the fuel vent line. The fuel expansion tank also includes a second restrictive orifice located in one the walls defining the enclosed chamber. The second restrictive orifice is adapted for direct parallel communication with the fuel vent line and has an internal cross sectional area less than the internal cross sectional area of the fuel vent line. The fuel expansion tank further includes means for attaching the chamber to the hull with the first restrictive orifice being positioned above the second restrictive orifice and proximate to a top edge of the chamber, and the second restrictive orifice being positioned above the fuel tank and proximate to a bottom edge of the chamber. The method further comprises attaching the first vent line fitting to the first restrictive orifice and attaching the second vent line fitting to the second restrictive orifice. If the fuel vent line is filled to a level at or above the first restrictive orifice then fuel is received into the expansion tank via the first restrictive orifice. If the fuel vent line is filled to a level at or above the second restrictive orifice then fuel is received into the fuel expansion tank via the second restrictive orifice. If the fuel vent line is filled to a level at or above the second restrictive orifice and below the first restrictive orifice then vapor and are vented out of the first restrictive orifice. If the fuel vent line is filled to a level below the second restrictive orifice then fuel is drained from the fuel expansion tank into the fuel vent line via the second restrictive orifice. If the fuel vent line is filled to capacity and more fuel is flowing into the fuel vent line at a rate higher than the maximum flow rate of the first restrictive orifice and the second restrictive orifice then fuel is vented from the fuel vent line into the vent.

A further aspect of the invention is a fuel expansion tank for use in the hull of a marine vessel that has a fuel system. The fuel system includes a fuel vent line connecting a fuel tank to a vent that communicates to the atmosphere. The fuel expansion tank comprises a plurality of walls defining an enclosed chamber and a first restrictive orifice located in one the walls. The first orifice is in direct communication with the first vent line fitting and has an internal cross sectional area less than the internal cross sectional area of the fuel vent line. The fuel expansion tank also comprises a second restrictive orifice located in one the walls defining the enclosed chamber. The second restrictive orifice has an internal cross sectional area less than the internal cross sectional area of the fuel vent line. The fuel expansion tank further comprises means for attaching the chamber to the hull with the first restrictive orifice being positioned above the second restrictive orifice and proximate to a top edge of the chamber, and the second restrictive orifice being positioned above the fuel tank and proximate to a bottom edge of the chamber.

DETAILED DESCRIPTION OF THE INVENTION

An exemplary embodiment of the present invention includes a fuel expansion tank installed in parallel with a fuel vent line to collect excess fuel when heating of the main fuel tank on a marine vessel causes the fuel to expand beyond the capacity of the main fuel tank. The configuration of the fuel expansion tank allows fuel to seep into the fuel expansion tank from the fuel vent line when the fuel level in the fuel vent line rises gradually due to thermal expansion. The restrictive orifices in the fuel expansion tank are sized so that a minimum amount of fuel enters the fuel expansion tank during refueling. During refueling, most of the excess fuel will exit the marine vessel via the fuel vent line unless other devices are installed to prevent the overflow.

Figure 1:
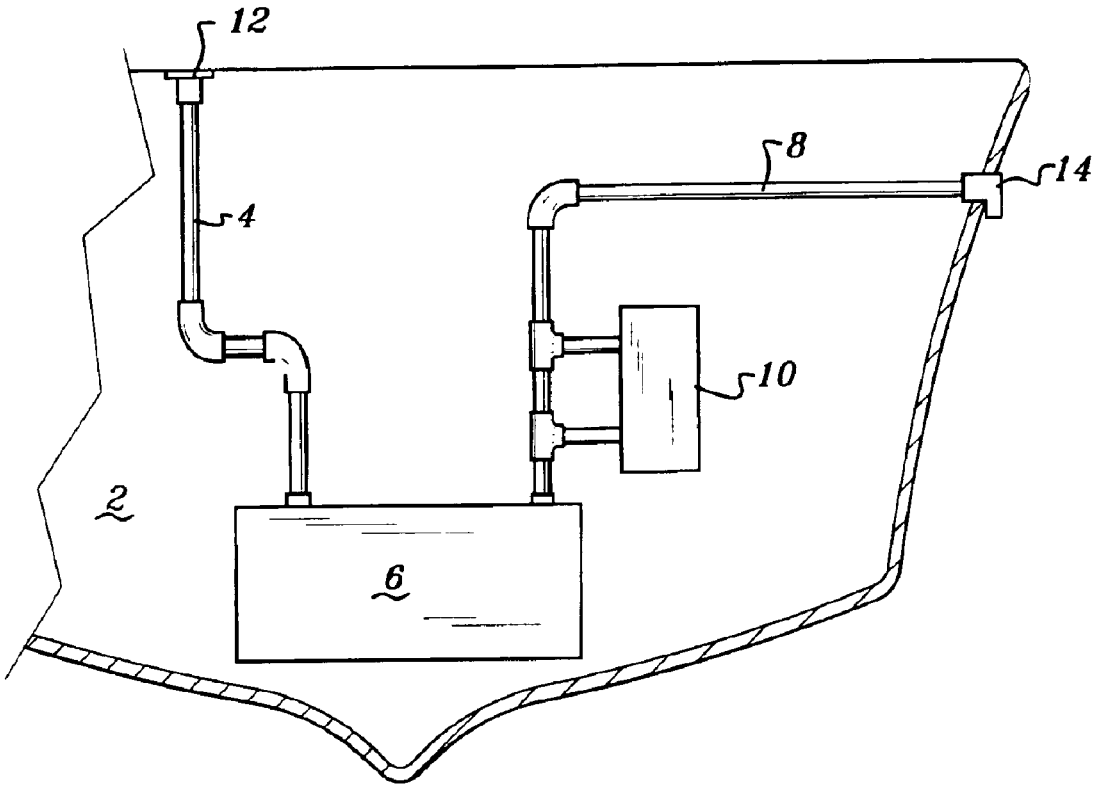
FIG. 1 is a diagrammatic view of a portion of a hull in a marine vessel, partially cut away to show an arrangement of a fuel expansion tank, a fuel tank, a fuel filler tube and a fuel vent line in accordance with an exemplary embodiment of the present invention.

FIG. 1 is a diagrammatic view of a portion of a hull 2 on a marine vessel, partially cut away to show an arrangement of a fuel expansion tank 10, a fuel tank 6, a fuel filler tube 4 and a fuel vent line 8 in accordance with an exemplary embodiment of the present invention. The fuel tank 6 supplies fuel to an inboard engine, not shown. A typical fuel tank 6 has a fitting thereon that receives the fuel filler tube 4 and the fuel filler tube 4 extends to a fuel deck type fuel fitting 12 mounted to the gunwale of the boat hull 2. Another fitting on the fuel tank 6 receives the fuel vent line 8. The fuel vent line 8 leads from the fuel tank 6 to a vent 14 that extends through the hull 2 of the marine vessel and vents the interior of the fuel tank 6 to the ambient atmosphere. The vent 14 may be located anywhere in the hull 2 of the marine vessel dependent on the choice of the boat designer and/or manufacturer.

Figure 2:
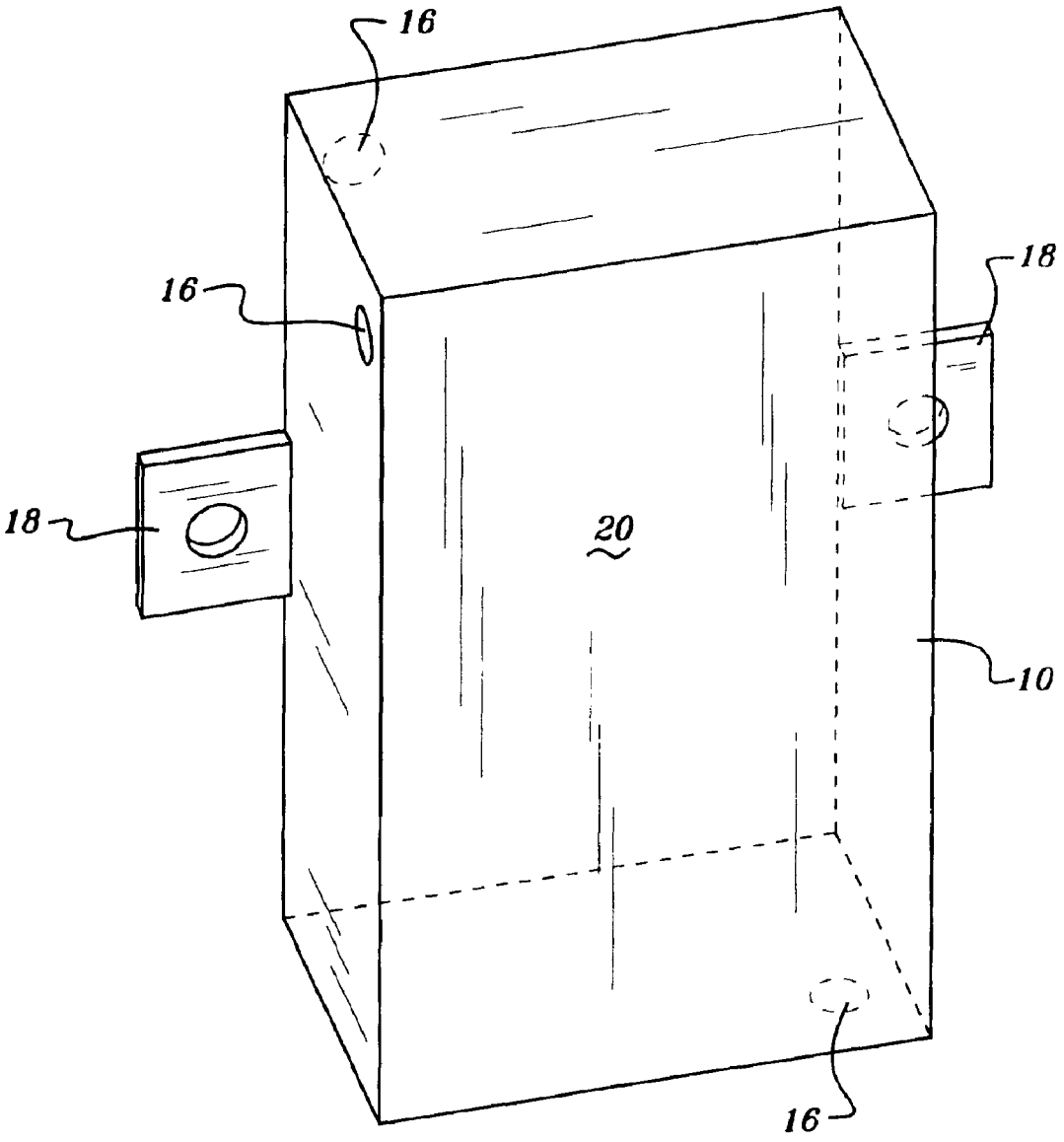
FIG. 2 is a perspective view of an exemplary embodiment of a fuel expansion tank.

FIG. 2 is a perspective view of an exemplary embodiment of a fuel expansion tank 10. The expansion tank 10 comprises a plurality of walls that define an enclosed chamber 20. The enclosed chamber 20 receives, stores and releases excess fuel created due to thermal expansion. The walls of the chamber 20 may be made of any material known in the art for storing fuel such as aluminum, steel and molded plastic. The rectangular shape depicted in FIG. 2 is arbitrarily chosen as other shapes (e.g., square, cylinder) would function equally as well depending on the configuration of a particular boat hull.

The size of the chamber 20 for a particular marine vessel depends on the size of the fuel tank 6 and the possible increase in capacity of the fuel due to thermal expansion over an expected temperature range. For example, a marine vessel with a fuel tank 6 of 100 gallons may require a fuel expansion tank 10 that can hold about three and one-quarter gallons of excess fuel (in this example gasoline) if the temperature of the fuel tank is expected to stay within a thirty-four degrees Celsius range. In this example, a rectangular chamber 20 measuring twelve inches by twelve inches by six inches may be utilized because if can accommodate at least three and one-quarter gallons of fuel. Other factors that may be taken into account in calculating the size of the fuel expansion tank 10 include the size of the fuel vent line 8 and the amount of fuel that will be stored in the fuel vent line 8 before fuel begins to enter the fuel expansion tank 10. It is anticipated that a limited number of fuel expansion tank 10 shapes and sizes will be required to cover most existing marine vessel configurations. However, in an alternate exemplary embodiment of the present invention, the size and shape of the fuel expansion tank 10 will vary and be custom designed based on the particular boat hull where the fuel expansion tank 10 is being installed.

FIG. 2 also shows three restrictive orifices 16 that connect the interior of the chamber 20 to the exterior of the chamber 20. In an exemplary embodiment of the present invention, a fuel expansion tank 10 includes two or more restrictive orifices 16 that are plugged for shipping. The customer can then decide, based on the configuration of the boat hull 2, which two restrictive orifices 16 to unplug for use in connecting to the fuel vent line 8. Providing several restrictive orifices 16 to choose from allows the fuel expansion tank 10 to be installed in a variety of positions, such as up and down, side ways and flat. In general the restrictive orifices 16 are close to the edges of the chamber 20 so that they may be used for draining fuel (if positioned near the bottom edge during installation) and allowing air and vapors to escape (if positioned near the top edge during installation). In the exemplary embodiment depicted in FIG. 2, the restrictive orifices 16 are round, but any shape that may be attached to a hose fitting connection may be utilized. In an exemplary embodiment of the present invention, the restrictive orifices 16 include threads for connecting a hose fitting and for securing the plugs into the chamber 20 in an air and liquid tight manner.

The restrictive orifices 16 are sized to prevent fuel from entering the fuel expansion tank 10 during refueling of the fuel tank 6. The restrictive orifices 16 perform restriction by size to allow fuel to slowly seep into the fuel expansion tank 10 but they deter fast moving fuel from flowing into the fuel expansion tank 10. Therefore, when the fuel tank 6 is being refueled, most of the excess fuel will move up the fuel line 8 and not into the fuel expansion tank 10. The size of the restrictive orifices 16 may vary based on the type of fuel (e.g., diesel, gasoline) in the fuel tank 6. In general, the flow rate through the restrictive orifices 16 must be less than the flow rate through the fuel vent line 8 (during normal operation at atmospheric pressure) to prevent the fuel expansion tank 10 from collecting an appreciable amount of fuel during refueling. In addition, the restrictive orifices 16 should be large enough so that they don't easily plug up with debris that may be contained in the fuel. In an exemplary embodiment of the present invention, the internal cross sectional area of the restrictive orifices 16 is about one eighth of the internal cross sectional area of the fuel vent line 8 and therefore the flow rate is also about one eighth. In another exemplary embodiment, the internal cross sectional area of the restrictive orifices is one sixteenth of the internal cross sectional area of the fuel vent line 8. In a further exemplary embodiment of the present invention, the diameter of the restrictive orifices 16 is in the range of from about three thirty-seconds (3/32) of an inch to about one-quarter (1/4) of an inch.

The exemplary embodiment depicted in FIG. 2 may also include two or more mounting brackets 18 for attaching the fuel expansion tank 10 to the hull 2 of the marine vessel. The fuel expansion tank 10 may be attached anywhere in the hull as long as it is positioned above the fuel tank 6. In an alternate exemplary embodiment, the fuel expansion tank 10 is mounted directly to the top of the fuel tank 6 or to the bulkhead. The mounting brackets 18 may be made from a metal such as aluminum to provide a ground for the fuel expansion tank 10. While mounting brackets 18 are disclosed for attachment, it is within the scope of the invention to utilize any alternate attachment devices suitable for use with the fuel expansion tank 10. For example, straps and/or brackets may be fitted to the hull 2 or the bulkhead of the marine vessel and utilized to attach the fuel expansion tank 10 to the marine vessel.

Figure 3:
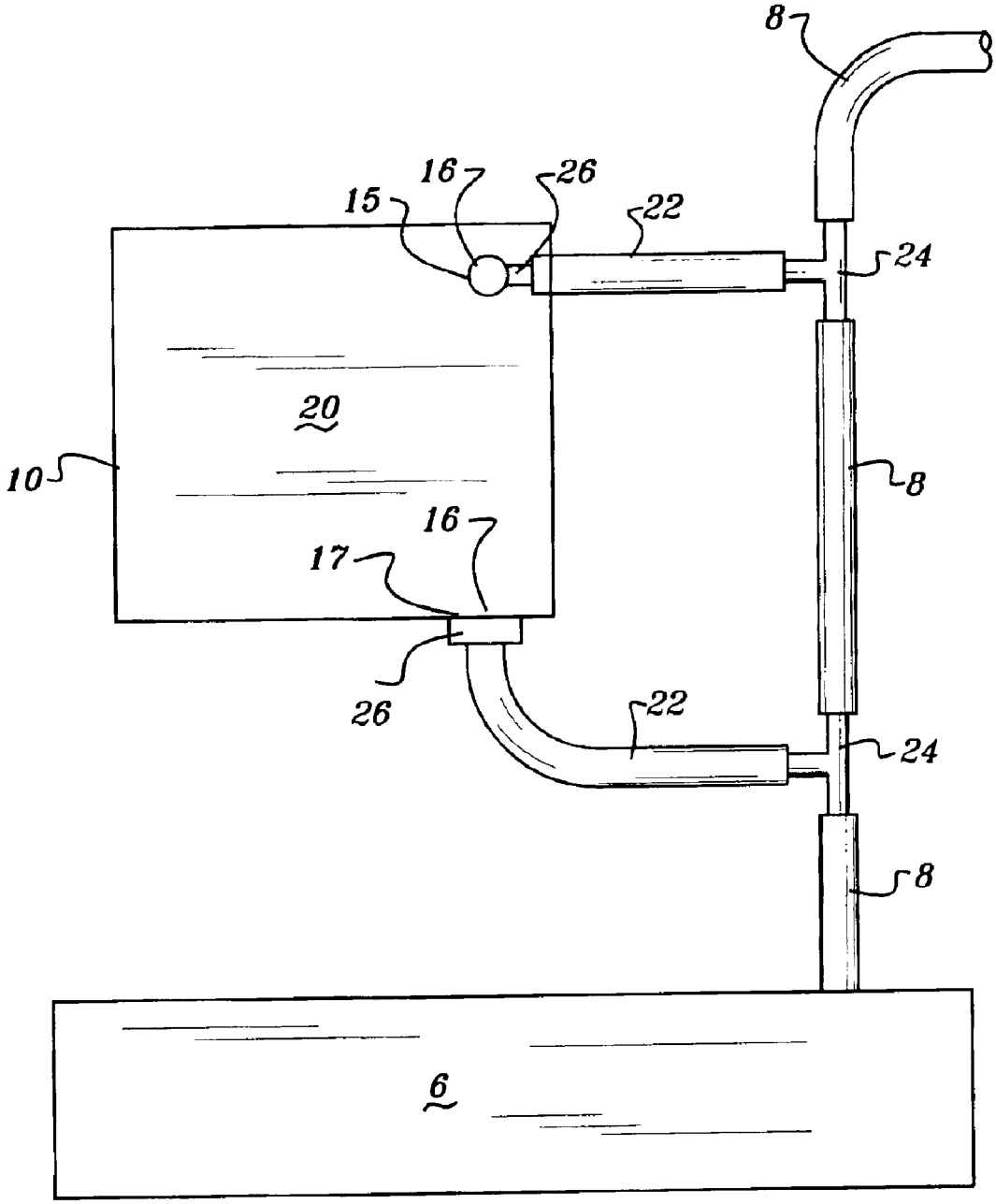
FIG. 3 is a side plan view of the fuel expansion tank of FIG. 2 connected to a fuel vent line in accordance with an exemplary embodiment of the present invention.

FIG. 3 is a side plan view of the fuel expansion tank 10 of FIG. 2 attached to a fuel vent line 8 in accordance with an exemplary embodiment of the present invention. The chamber 20 of the fuel expansion tank 10 is mounted above the fuel tank 6 to allow fuel collected in the chamber 20 to drain back into the fuel tank 6 when the fuel tank 6 has excess capacity. A first restrictive orifice 15, selected from the two or more restrictive orifices 16 in the chamber 20 is unplugged and is positioned near a top edge of the chamber 20. A second restrictive orifice 17, selected from the two or more restrictive orifices 16 in the chamber 20 is unplugged and is positioned near a bottom edge of the chamber 20 to allow for drainage of fuel into the fuel tank 6 via the fuel vent line 8.

In an exemplary embodiment of the present invention, the first restrictive orifice 15 and the second restrictive orifice 17 are the same size and in an alternate embodiment, the first restrictive orifice 15 is smaller than the second restrictive orifice 17. The internal cross sectional area of the restrictive orifice 16 directly impacts the maximum flow rate through the restrictive orifice 16 into the chamber 20 and out of the chamber 20. Unless the level of the fuel in the fuel vent line 8 is higher than the first restrictive orifice 15, the first restrictive orifice 15 is utilized to release fuel vapor and air from the chamber 20. As fuel enters the second restrictive orifice 17, fuel vapor and air are released from the chamber 20 via the first restrictive orifice 15. The first restrictive orifice 15 may be made smaller to further restrict the rate that the fuel enters the chamber 20. In an alternate exemplary embodiment, a shut-off valve may be attached to the first restrictive orifice 15 to further regulate the rate at which fuel enters the fuel expansion tank 10.

The optional exterior fitting 26 threaded into the restrictive orifice 16 may be any type of hose fitting known in the art and approved for use with fuel and vent lines. For example, the exterior fitting 26 may be a tube fitting or a barbed fitting. The exterior fitting 26 is adapted for direct parallel communication with the fuel vent line 8. In an exemplary embodiment, the direct parallel communication occurs via two T vent line fittings 24 spliced into the fuel vent line 8. The vent line fittings 24 may be any type known in the art for use in fuel and vent lines, such as a locking collar T fitting, a barbed T fitting with clamps or a T tube fitting. In this example, T vent line fittings 24 are utilized for connection to the fuel expansion tank 10 because they do not interfere with the normal operation of the fuel vent line 8. The vent line fitting 24 should provide an unrestricted path to the fuel vent line 8. Also shown in FIG. 3 is a length of flexible tubing 22 connecting the vent line fittings 24 to the corresponding exterior fitting 26. The lower vent line fitting 24 is in communication with the second restrictive orifice 17 located near the bottom edge of the chamber 20 and the upper vent line fitting 24 is in communication with the first restrictive orifice 15 located near the top edge of the chamber 20.

Other hardware arrangements for providing direct parallel connection between the fuel vent line 8 and the fuel expansion tank 10 are possible as long as the connection does not restrict the fuel vent line 8. Direct communication refers to there being no restrictive devices or shut-off valves between the fuel expansion tank 10 and the fuel vent line 8. The only restriction in flow occurs due to the size of the restrictive orifices 16 in the fuel expansion tank 10. Parallel communication refers to the manner in which the fuel expansion tank 10 is installed relative to the fuel vent line 8. In an exemplary embodiment of the present invention, the fuel expansion tank 10 does not interrupt or restrict the normal flow through the fuel vent line 8. Instead, the fuel expansion tank 10 taps into the fuel vent line with a T-fitting 24 to allow fuel from the fuel vent line 8 to seep into the fuel expansion tank 10. In this manner, fuel slowly entering the fuel vent line 8 due to thermal expansion may seep into the fuel expansion tank 10, wherein unobstructed communication is provided between the first restrictive orifice 15, the chamber 20, the second restrictive orifice 17, the vent line fittings 24 and the fuel vent line 8.

An alternate exemplary embodiment of the present invention includes a control valve connected to the second restrictive orifice 17 via the flexible tubing 22 leading to the second restrictive orifice 17 or via the exterior fitting leading to the second restrictive orifice 17. During typical operation, the control valve is set to a particular diameter (e.g., one-eighth of an inch) to control the effective size of the diameter of the second restrictive orifice. On a periodic basis, the shut-off valve is opened to a larger diameter (e.g., one-quarter of an inch) to allow any debris that has collected at the second restrictive orifice 17 to pass either into the chamber 20 or out of the chamber 20 via the second restrictive orifice 17. The second restrictive orifice 17 is at least as big as the larger diameter (e.g., one-quarter of an inch). The control valve then returns to the original setting (e.g., one-eighth of an inch) after a specified period of time. In this manner, the control valve may be utilized to flush the second restrictive orifice 17 and aid in preventing debris from clogging the second restrictive orifice 17.

The ability to provide a fuel expansion tank 10 that collects fuel that has expanded beyond the capacity of the main fuel tank 6 due to thermal expansion may prevent fuel from flowing out of the vent 14 into the water. In addition, the ability of the fuel expansion tank 10 to operate in parallel with the fuel vent line 8 allows the fuel vent line 8 to operate in a standard manner. Not restricting the fuel vent line 8 avoids problems associated with faulty shut off valves and other devices that may stick and cause increased pressure in the fuel system and a potential explosion. In addition, the operator performing refueling will see that fuel is entering the fuel vent line 8 and will shut off the fueling device without filling the fuel expansion tank 10. In this manner, the fuel expansion tank 10 is left substantially empty in order to accommodate excess fuel capacity due to thermal expansion. In general, marinas do not currently have fueling devices with automatic shut-off valves (e.g., as used at gas stations for vehicles) and the ability to visually gauge when the tank is full is important to determining when to shut off the fuel flow into the marine vessel. An embodiment of the present invention may be installed as standard equipment on new marine vessels or installed as after market equipment in existing marine vessels.

While the invention has been described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another.

What is claimed is:

1. A marine vessel fuel overflow tank system for use in the hull of a marine vessel that has a fuel system including a fuel vent line connecting a fuel tank to a vent that communicates with the atmosphere, said system comprising:

a first vent line fitting adapted for direct parallel communication with the fuel vent line, wherein the internal cross sectional area of said first vent line fitting is approximately the same size as the internal cross sectional area of said fuel vent line;

a second vent line fitting adapted for direct parallel communication with the fuel vent line, wherein the internal cross sectional area of said second vent line fitting is approximately the same size as the internal cross sectional area of said fuel vent line; and a fuel expansion tank comprising:

a plurality of walls defining an enclosed chamber;

a first restrictive orifice located in one of said walls in direct communication with said first vent line fitting, wherein said first restrictive orifice has an internal cross sectional area less than the internal cross sectional area of the fuel vent line;

a second restrictive orifice located in one of said walls in direct communication with said second vent line fitting, wherein said second restrictive orifice has an internal cross sectional area less than the internal cross sectional area of the fuel vent line; and means for attaching said chamber to the hull with said first restrictive orifice being positioned above said second restrictive orifice and proximate to a top edge of said chamber, and said second restrictive orifice being positioned above said fuel tank and proximate to a bottom edge of said chamber.

2. The system of claim 1 further comprising a first and second length of flexible tubing, wherein said first restrictive orifice is in direct communication with said first vent line fitting via said first length of flexible tubing and said second restrictive orifice is in direct communication with said second vent line fitting via said second length of flexible tubing.

3. The system of claim 1 wherein said chamber includes a plurality of plugged restrictive orifices, wherein said first restrictive orifice and said second restrictive orifice are selected from said plurality of plugged restrictive orifices and the plugs corresponding to said first restrictive orifice and said second restrictive orifice are removed.

4. The system of claim 1 wherein said first vent line fitting and said second vent line fitting do not obstruct said fuel vent line when in direct parallel communication with said fuel vent line.

5. The system of claim 1 wherein said first vent line fitting and said second vent line fitting are T-shaped.

6. The system of claim 1 wherein the internal cross sectional area of said first restrictive orifice restricts the maximum flow rate through said first orifice for limiting an amount of fuel from entering said fuel expansion tank via said first restrictive orifice during refueling of the fuel tank; and the internal cross sectional area of said second restrictive orifice restricts the maximum flow rate through said second orifice for limiting an amount of fuel from entering said fuel expansion tank via said second restrictive orifice during refueling of the fuel tank.

7. The system of claim 1 wherein the internal cross sectional area of said first restrictive orifice is the same as the internal cross sectional area of said second restrictive orifice.

8. The system of claim 1 wherein the internal cross sectional area of said first restrictive orifice is less than the internal cross sectional area of said second restrictive orifice.

9. The system of claim 1 wherein the internal cross sectional area of said second restrictive orifice is between about one-eighth of the internal cross sectional area of the fuel vent line and about one-sixteenth of the internal cross sectional area of the fuel vent line.

10. The system of claim 1 wherein said first restrictive orifice has a diameter between about three thirty-seconds of an inch and about one-quarter of an inch.

11. The system of claim 1 wherein said second restrictive orifice has a diameter between about three thirty-seconds of an inch and about one-quarter of an inch.

12. The system of claim 1 wherein said plurality of walls are aluminum.

13. The system of claim 1 wherein said enclosed chamber is rectangular in shape.

14. The system of claim 1 wherein said enclosed chamber is cylindrical in shape.

15. The system of claim 1 wherein the means for attaching said chamber includes metal brackets.

16. The system of claim 1 wherein the enclosed chamber is adapted to contain gasoline.

17. The system of claim 1 wherein the enclosed chamber is adapted to contain diesel.

18. The system of claim 1 further comprising a control valve attached to said second restrictive orifice for varying the effective internal cross sectional area of said second restrictive orifice.

19. In combination, a fuel system and a fuel expansion tank for use in the hull of a marine vessel, the fuel system comprising:

a fuel tank;

a filler tube open to said fuel tank for delivering fuel to the fuel tank; and a fuel vent line in fluid communication with the fuel tank and the atmosphere, the fuel vent line including a first vent line fitting and a second vent line fitting both adapted for direct parallel communication with the fuel expansion tank; and the fuel expansion tank comprising:

a plurality of walls defining an enclosed chamber;

a first restrictive orifice located in one of said walls in direct parallel communication with said first vent line fitting, wherein said first restrictive orifice has an internal cross sectional area less than the internal cross sectional area of the fuel vent line;

a second restrictive orifice located in one of said walls in direct parallel communication with said second vent line fitting, wherein said second restrictive orifice has an internal cross sectional area less than the internal cross sectional area of the fuel vent line; and means for attaching said chamber to the hull with said first restrictive orifice being positioned above said second restrictive orifice and proximate to a top edge of said chamber, and said second restrictive orifice being positioned above said fuel tank and proximate to a bottom edge of said chamber.

20. The combination of claim 19 wherein:

the internal cross sectional area of said first restrictive orifice restricts the maximum flow rate through said first orifice for limiting an amount of fuel from entering said fuel expansion tank via said first restrictive orifice during refueling of the fuel tank; and the internal cross sectional area of said second restrictive orifice restricts the maximum flow rate through said second orifice for limiting an amount of fuel from entering said fuel expansion tank via said second restrictive orifice during refueling of the fuel tank.

21. The combination of claim 19 wherein said second restrictive orifice is positioned to allow the contents of said expansion tank to drain into the fuel tank via the fuel vent line.

22. A method of utilizing a fuel expansion tank in the hull of a marine vessel that has a fuel system including a fuel vent line connecting a fuel tank to a vent that communicates with the atmosphere, wherein the fuel vent line includes a first vent line fitting and a second vent line fitting both adapted for direct parallel communication with the fuel expansion tank, the method comprising:

attaching the fuel expansion tank to the marine vessel, wherein the fuel expansion tank includes:

a plurality of walls defining an enclosed chamber;

a first restrictive orifice located in one of said walls in direct communication with said first vent line fitting, wherein said first restrictive orifice has an internal cross sectional area less than the internal cross sectional area of the fuel vent line;

a second restrictive orifice located in one of said walls in direct communication with said second vent line fitting, wherein said second restrictive orifice has an internal cross sectional area less than the internal cross sectional area of the fuel vent line; and means for attaching said chamber to the hull with said first restrictive orifice being positioned above said second restrictive orifice and proximate to a top edge of said chamber, and said second restrictive orifice being positioned above said fuel tank and proximate to a bottom edge of said chamber;

attaching said first vent line fitting to said first restrictive orifice;

attaching said second vent line fitting to said second restrictive orifice;

wherein, if the fuel vent line is filled to a level at or above said first restrictive orifice then receiving fuel into said fuel expansion tank via said first restrictive orifice;

wherein, if the fuel vent line is filled to a level at or above said second restrictive orifice then receiving the fuel into said fuel expansion tank via said second restrictive orifice;

wherein, if the fuel vent line is filled to a level at or above said second restrictive orifice and below said first restrictive orifice then venting vapor and air out of said first restrictive orifice;

wherein, if the fuel vent line is filled to a level below said second restrictive orifice then draining the fuel from said fuel expansion tank into the fuel vent line via said second restrictive orifice; and wherein, if the fuel vent line is filled to capacity and more fuel is flowing into said fuel vent line at a rate higher than the maximum flow rate of said first restrictive orifice and said second restrictive orifice then venting the fuel from said fuel vent line into the vent.

* * * * *